US006764333B2

(12) United States Patent
Pocrass

(10) Patent No.: US 6,764,333 B2
(45) Date of Patent: Jul. 20, 2004

(54) RJ-TYPE MALE PLUG WITH INTEGRAL WIRE SHIELDS

(76) Inventor: Alan L. Pocrass, 41 Golden Glen, Simi Valley, CA (US) 93065

( * ) Notice: Subject to any disclaimer, the term of this patent is extended or adjusted under 35 U.S.C. 154(b) by 0 days.

(21) Appl. No.: 10/618,339

(22) Filed: Jul. 11, 2003

(65) Prior Publication Data

US 2004/0009699 A1 Jan. 15, 2004

Related U.S. Application Data

(60) Provisional application No. 60/381,831, filed on Jul. 11, 2002.

(51) Int. Cl.[7] ..... H01R 11/20
(52) U.S. Cl. ..... 439/418; 439/676
(58) Field of Search ..... 439/418, 676, 439/941, 608, 344

(56) References Cited

U.S. PATENT DOCUMENTS 6,409,544 B1 * 6/2002 Wu ..... 439/418
6,506,077 B2 * 1/2003 Nagel ..... 439/418
6,524,128 B2 * 2/2003 Marowsky et al. ..... 439/418
6,561,838 B1 * 5/2003 Blichfeldt ..... 439/418
6,592,397 B2 * 7/2003 Pocrass ..... 439/418

* cited by examiner

*Primary Examiner*—Tho D. Ta
(74) *Attorney, Agent, or Firm*—Webb Ziesenheim Logsdon Orkin & Hanson, P.C.

(57) ABSTRACT

An RJ-type plug for insertion into an RJ-type housing used in data communication or telecommunication applications includes a plug body, an electrically insulating sleeve, wire shields and a plurality of terminal blades. The electrically insulating sleeve houses the electrically conductive wire shields which, when in contact with each other, form a faraday cage or shield around each wire installed therein. The plug body includes a cavity for receiving the electrically insulating sleeve and a plurality of blade receiving slots in the top and bottom surfaces therein. The terminal blades are inserted into the blade receiving slots of the plug body into contact with the stripped end of the wires.

4 Claims, 6 Drawing Sheets

RJ-TYPE MALE PLUG WITH INTEGRAL WIRE SHIELDS

CROSS REFERENCE TO RELATED APPLICATIONS

This application claims the benefit of U.S. Provisional Patent Application No. 60/381,831, filed Jul. 11, 2002.

BACKGROUND OF THE INVENTION

1. Field of the Invention

The present invention relates to electrical connectors and, more specifically, to RJ-type connectors for connection of twisted pair cables.

2. Background Art

A modular receptacle jack, also known as an RJ connector, is commonly used in telecommunication and data networking equipment. An RJ connector typically forms a link between two pieces of equipment to provide a means of communication between the equipment. The invention provides a means for reducing electromagnetic interference, such as near end cross talk (NEXT), between wires.

DETAILED DESCRIPTION OF THE INVENTION

The present invention will be described with reference to the accompanying figures where like reference numbers correspond to like elements. The following detailed description includes words such as, "front," "back," "top" and "bottom." It is to be understood that these words are used in connection with the various views and embodiments of the present invention shown in the figures and are not to be construed as limiting the invention.

Figure 1B:
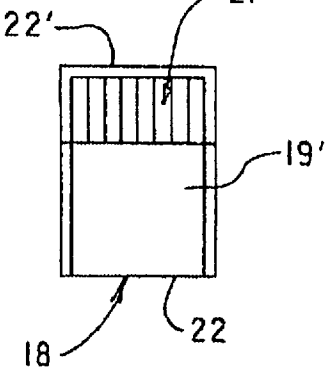
FIG. 1*b* is a top view of the sleeve shown in FIG. 1*a;*
Figure 1A:
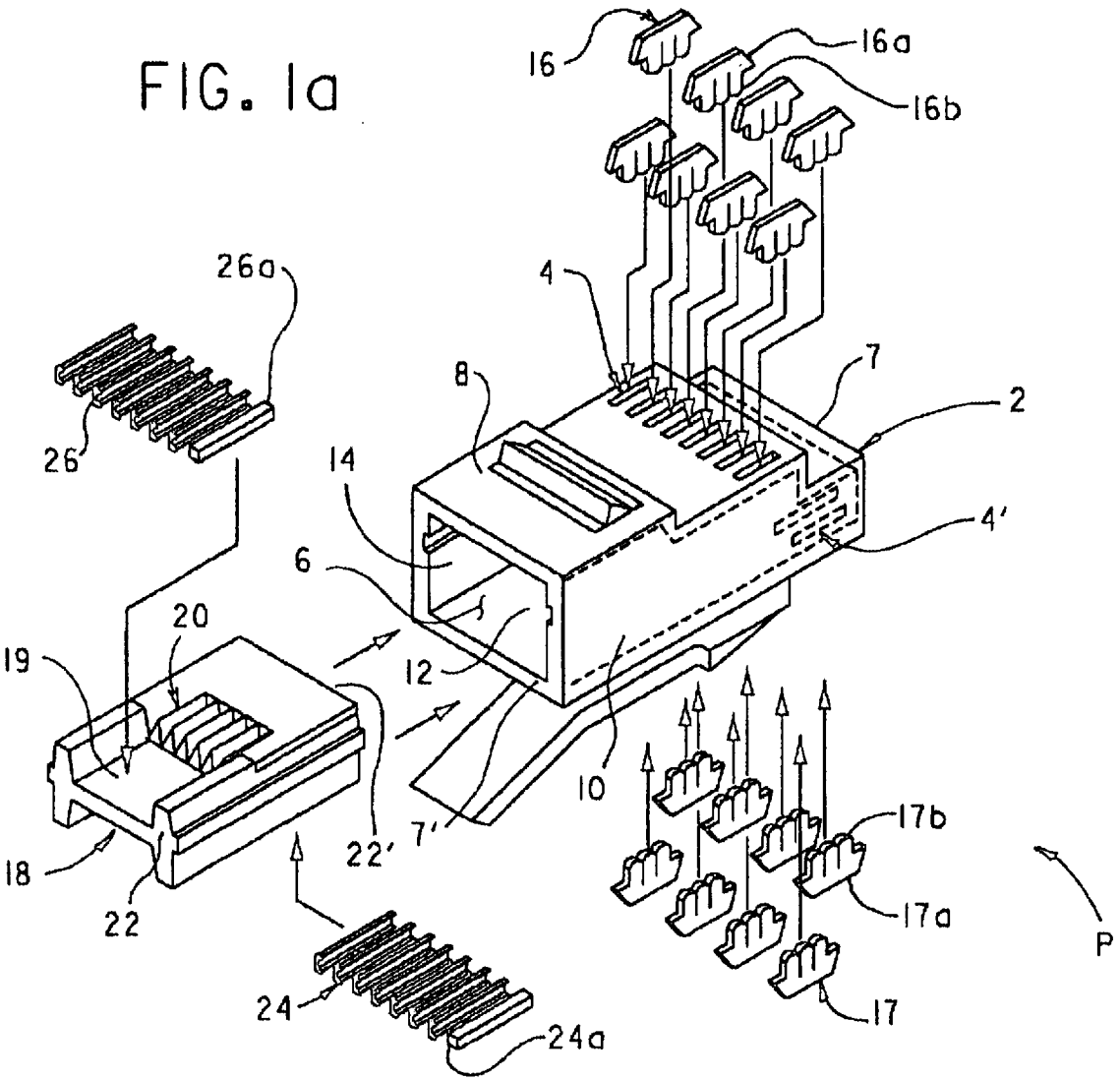
FIG. 1*a* is an exploded sectional view of the plug body and sleeve.

With reference to FIG. 1*a*, an RJ-type male plug P includes a plug body 2 having a plurality of blade receiving slots 4 and 4' in a top wall 8 and a bottom wall 12 thereof. Slots 4' can be positioned adjacent a front end 7 of plug body 2 while slots 4 can be positioned between slots 4' and a back end 7' of plug body 2 adjacent slots 4'. Alternatively, the positions of slot 4 and 4' can be reversed, with slots 4 positioned adjacent front end 7 and with slots 4' positioned between slots 4 and back end 7' of plug body 2.

An outer surface of top wall 8 defines a top of plug body 2, while an outer surface of bottom wall 12 defines a bottom of plug body 2. Plug body 2 includes a cavity 6 defined by an inner surface of top wall 8, an inner surface of bottom wall 12, and opposing inner surfaces of side walls 10 and 14. As shown in FIG. 1*a*, cavity 6 extends from adjacent front end 7 of plug body 2 and debouches from an opening in back end 7' of plug body 2.

Plug body 2 includes a plurality of terminal blades 16 and 17. Each terminal blade 16 and 17 includes a contact end 16*a* and 17*a* and a wire engaging end 16*b* and 17*b*, respectively. Each contact end 16*a* and 17*a* can be flat while each wire engaging end 16*b* and 17*b* can have a serrated edge. Each terminal blade 16 is positioned in a slot 4 with contact end 16*a* terminating adjacent the outer surface of top wall 8 of plug body 2 and with wire engaging end 16*b* terminating inside cavity 6. Each terminal blade 17 is positioned in a slot 4' with contact end 17*a* terminating adjacent the outer surface of bottom wall 12 of plug body 2 and with wire engaging end 17*b* terminating inside cavity 6.

With reference to FIG. 1*b*, and with continuing reference to FIG. 1*a*, RJ-type male plug P includes an electrically insulating sleeve 18 configured to be inserted into cavity 6 through the opening in back end 7' of plug body 2. Sleeve 18 has a top surface 19 and a bottom surface 19' which define a plurality of wire troughs 20 and 21, respectively. Each wire trough 20 and 21 is aligned with a corresponding slot 4 and 4', respectively, of plug body 2 when sleeve 18 is inserted into cavity 6.

Sleeve 18 includes a plurality of electrically conductive wire shields 24 and 26, and end wire shields 24*a* and 26*a* positioned on top surface 19 and bottom surface 19'. Wire shields 24 and 26, and end wire shields 24*a* and 26*a* extend from a back end 22 of sleeve 18 toward a front end 22' of sleeve 18 in alignment with corresponding wire troughs 20 and 21 and terminate at an end of corresponding wire troughs 20 and 21 closest to back end 22 of sleeve 18.

Figure 2:
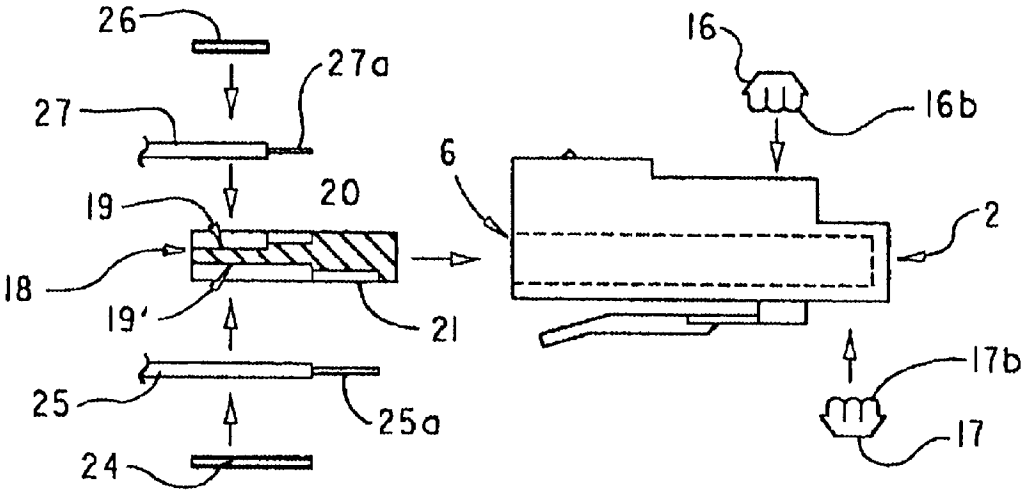
FIG. 2 is an exploded side view of the plug body and sleeve of FIG. 1*a;*
Figure 3:
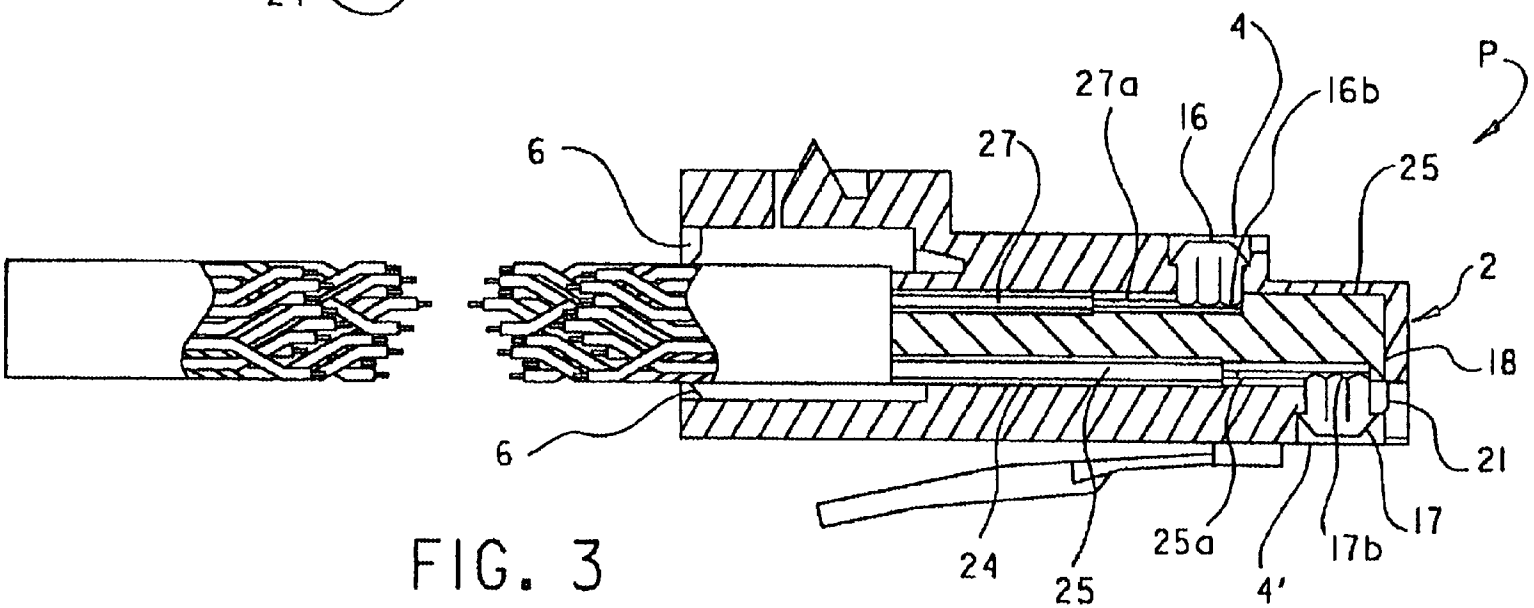
FIG. 3 is a cross sectional side view of the assembled plug body and sleeve.

With reference to FIGS. 2 and 3 and with continuing reference to FIGS. 1*a* and 1*b*, each wire shield 24 and 26 is configured to receive and partially surround an insulating portion of a corresponding insulated wire 25 and 27. To this end, each wire shield 24 and 26 has an open side, while the sides of each end wire shield 24*a* and 26*a* are closed and fully surround the insulating portion of the corresponding insulated wire 25 and 27. When the open side of each wire shield 24 faces one of the sides of end wire shield 24*a*, and all wire shields 24 and end wire shield 24*a* are moved into electrical contact with each other, a faraday cage or shield is formed around the insulating portion of each insulating wire 25 received in a wire shield 24 or end wire shield 24*a*. Similarly, when the open side of each wire shield 26 faces one of the sides of end wire shield 26*a*, and all wire shields 26 and end wire shield 26*a* are moved into electrical contact with each other, a faraday cage or shield is formed around the insulating portion of each insulated wire 27 positioned in a corresponding wire shield 26 or end wire shield 26*a*. The shapes of wire shields 24 and 26 and end wire shields 24*a* and 26*a* shown in the figures are not to be construed as limiting the invention, since any suitable shape that forms a faraday cage or shield can be used. If desired, wire shields 24 and 24*a*, and wire shields 26 and 26*a* can be connected in electrical contact with each other by any suitable means.

Prior to insertion of sleeve 18 into plug body 2, the ends of one or more insulated wires 25 and/or 27 are stripped to form stripped ends 25*a* and 27*a*, respectively. Thereafter, one or more insulated wires 25 are positioned in one or more wire shields 24 and/or end wire shield 24*a* with stripped end 25*a* of each insulated wire 25 extending therefrom into the wire trough 21 in alignment therewith. One or more insulated wires 27 can also be positioned in one or more wire shields 26 and/or end wire shield 26*a* with stripped end 27*a* of each insulated wire 27 extending therefrom into the wire trough 20 in alignment therewith. Once all desired wires 25 and 27 have been positioned in corresponding wire shields 24, 26, 24*a* and/or 26*a*, sleeve 18 is inserted, e.g., press fit, into cavity 6 via the opening in back end 7' of plug body 2.

Alternatively, sleeve 18, including wire shields 24 and 26, and end wire shields 24*a* and 26*a* installed thereon, is inserted, e.g., press fit, into cavity 6 via the opening in back end 7' of plug body 2. One or more insulated wires 25 and 27 are then inserted into wire shields 24 and 26, and/or end wire shields 24*a* and 26*a* until the stripped ends 25*a* and 27*a* thereof are positioned in corresponding wire troughs 21 and 20 in registry with corresponding wire slots 4 and 4'.

Next, one terminal blade 17 is inserted into each slot 4' having a stripped end 25*a* in registry therewith until wire engaging end 17*b* of terminal blade 17 engages the stripped end 25*a* of insulated wire 25. Likewise, one terminal blade 16 is inserted into each slot 4 having a stripped end 27*a* in registry therewith until wire engaging end 16*b* of terminal blade 16 engages stripped end 27*a* of insulated wire 27. Each terminal blade 16 and 17 is configured to press fit into a corresponding slot 4 and 4' when it is inserted therein. This press fit not only secures each terminal blade 16 and 17 in plug body 2 but also secures the position of corresponding insulated wires 25 and 27 therein due to interaction between stripped ends 25*a* and 27*a* and wire engaging ends 17*b* and 16*b* of terminal blades 17 and 16. If desired, a channel formed by the alignment of a wire trough 21 or 20 with a corresponding wire shield 24 and 26, or end wire shield 24*a* and 26*a*, may not contain a wire whereupon a terminal blade 16 or 17 can be omitted from the slot 4 or 4' in alignment with the channel.

Figure 4A:
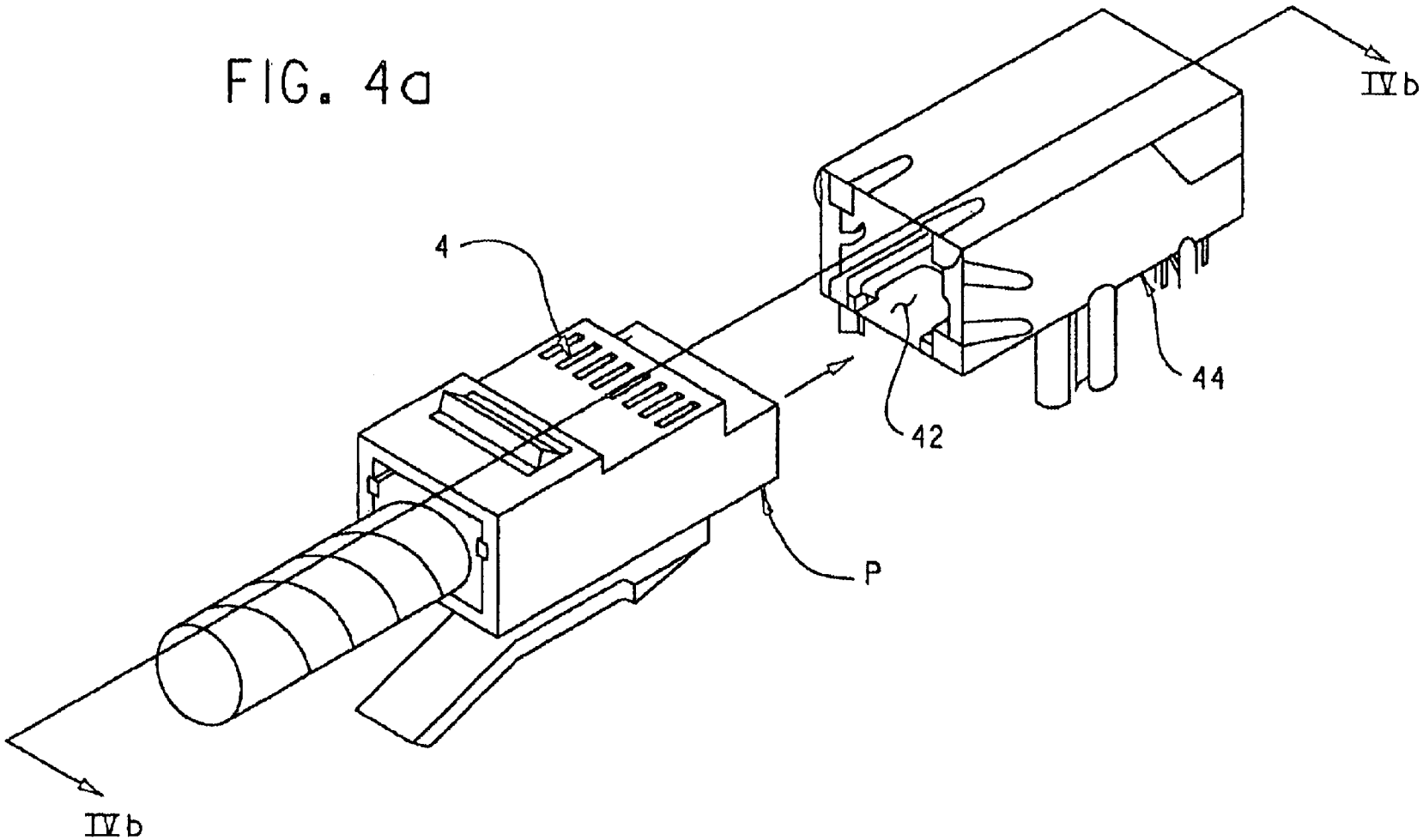
FIG. 4*a* is a perspective view of a RJ-type male plug and a RJ-type female housing in the form of a common RJ-type connector to provide a snap fit connection for cables.
Figure 4B:
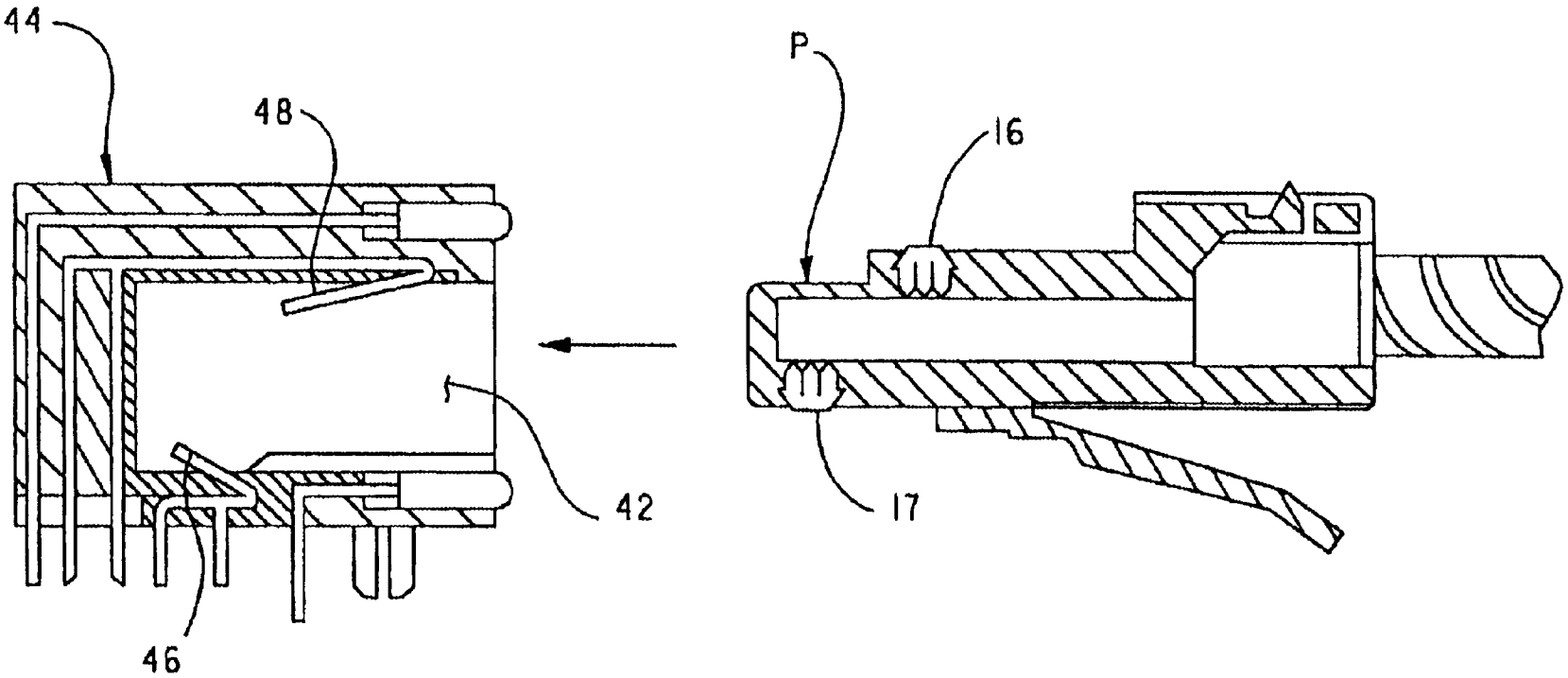
FIG. 4*b* is a cross-section taken along lines IVb—IVb in FIG. 4*a;*
Figure 4C:
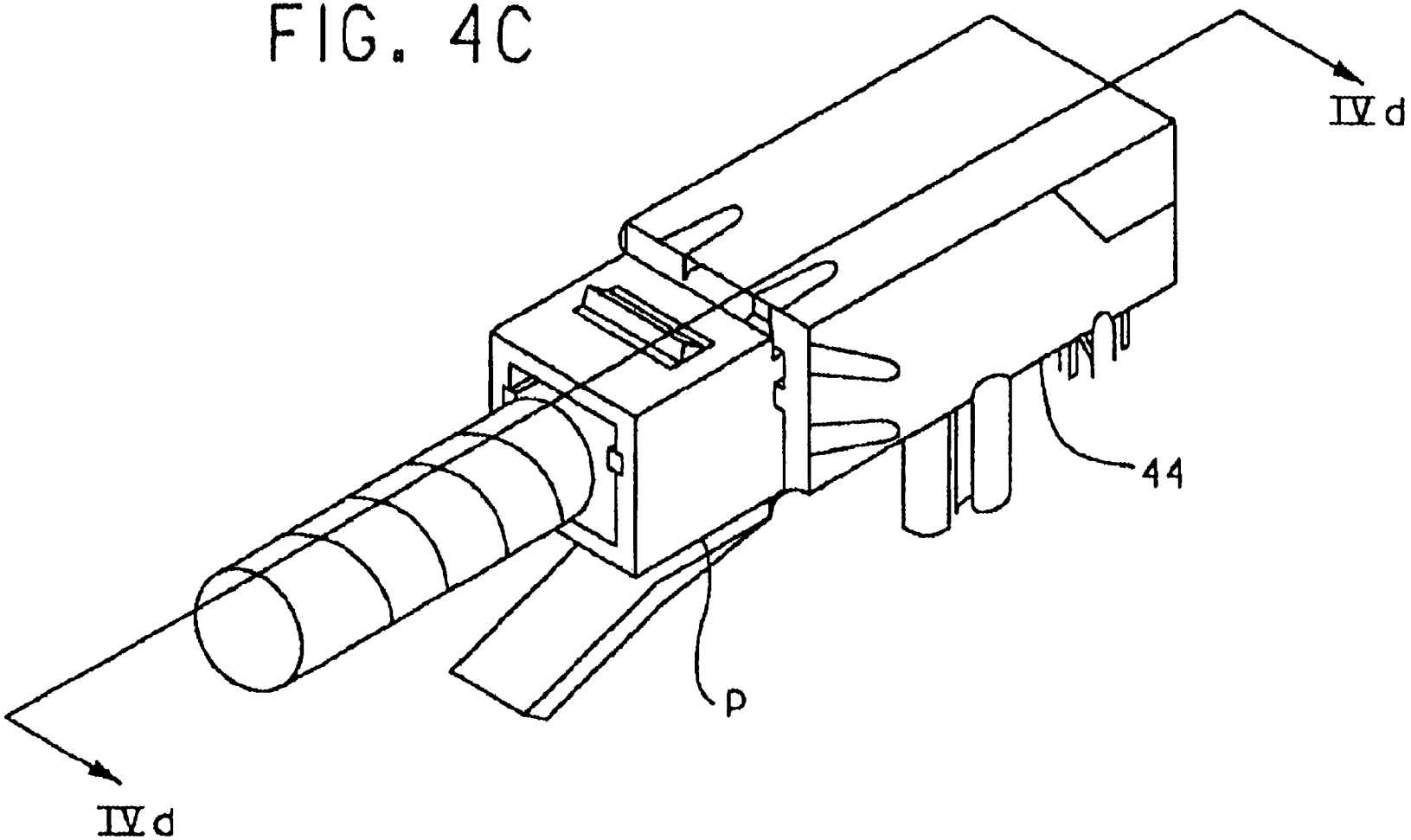
FIG. 4*c* is a perspective view of the mated RJ-type male plug and RJ-type housing shown FIG. 4*a*.
Figure 4D:
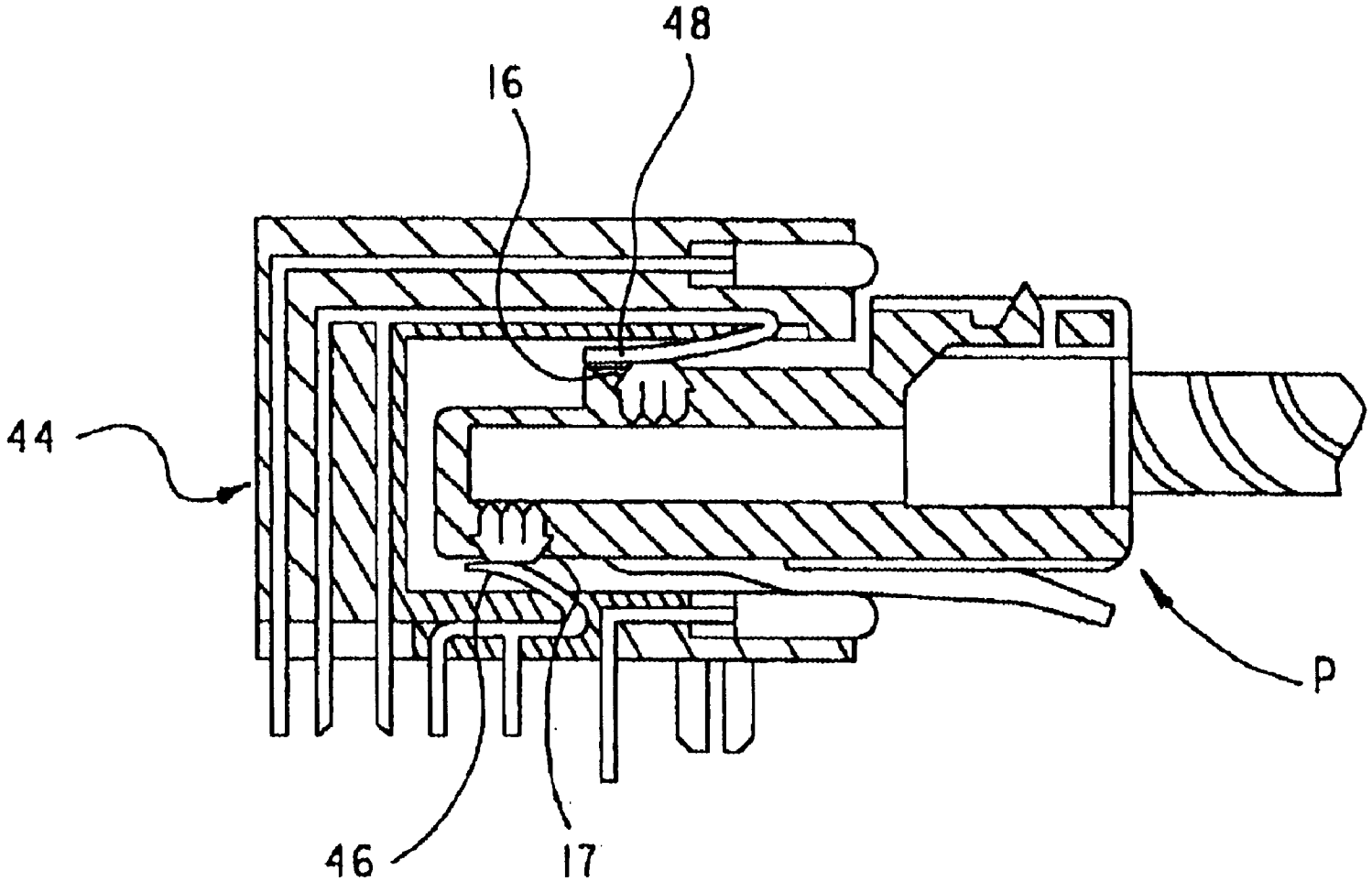
FIG. 4*d* is a cross-section taken along lines IVd—IVd in FIG. 4*c*.

With reference to FIGS. 4*a*–4*d*, FIG. 4*a* shows RJ-type male plug P aligned with an internal cavity 42 of an RJ-type housing 44. FIG. 4*b* shows terminal blades 16 and 17 of RJ-type male plug P aligned with corresponding contact terminals 46 and 48 of an RJ-type housing 44. In FIG. 4*c*, RJ-type male plug P is shown seated in internal cavity 42 of RJ-type housing 44, whereupon RJ-type male plug P locks to RJ-type housing 44 until such time as it is released therefrom. In FIG. 4*d*, contact terminals 46 and 48 of RJ-type housing 44 are shown in contact with terminal blades 16 and 17 of RJ-type male plug P, thereby completing connections therebetween.

When wire shields 24 and 24*a* are moved into electrical contact, a faraday cage or shield is formed around each insulated wire 25 received therein. Similarly, when wire shield 26 and 26*a* are moved into electrical contact, a faraday cage or shield is formed around each insulated wire 27 received therein. Each faraday cage or shield shields the insulated wire received therein from electromagnetic interference, such as near end cross-talk (NEXT). If desired, wire shields 24, 24*a*, 26*a* can be connected in a suitable manner to a reference potential, such as electrical ground, to enhance the shielding of each wire shield 24, 24*a*, 26 and 26*a* against electromagnetic interference.

The present invention has been described with reference to the preferred embodiments. Obvious modifications and alterations will occur to others upon reading and understanding the preceding detailed description. For example, the plug in the preferred embodiment contains 16 slots, 8 each on the top and bottom surfaces, however, the plug can be formed with any number of slots that are desired. It is intended that the invention be construed as including all such modifications and alterations insofar as they come within the scope of the appended claims or the equivalents thereof.

The invention claimed is:

1. An RJ-type plug for insertion into an RJ-type housing to form an electrical connection in data communication or telecommunication applications, wherein the RJ-type plug comprises:

a plug body having a receiving cavity extending from adjacent one end of the plug body and debouching from an opening at an opposite end of the plug body;

a plurality of terminal blades each having a contact end and a serrated wire engaging end;

a plurality of blade receiving slots in top and bottom surfaces of the plug body for housing the terminal blades;

an electrically insulating sleeve having a plurality of wire troughs on top and bottom surfaces thereon, whereupon the wire troughs align with the blade receiving slots of the plug body when the electrically insulating sleeve is inserted in the receiving cavity of the plug body; and a plurality of electrically conductive wire shields positioned on the top and bottom surfaces of the sleeve in alignment with the wire troughs on the top and bottom surfaces for receiving a plurality of insulated wires whereupon an insulating portion of each wire is received in one of the wire shields and a stripped end of each wire extends into the wire trough in alignment with said wire shield and into contact with one of the terminal blades.

2. The RJ-type plug as set forth in claim 1, wherein the wire shields on the top surface are in electrical contact with each other and the wire shields on the bottom surface are in electrical contact with each other.

3. The RJ-type plug as set forth in claim 1, wherein the terminal blades are received in the blade receiving slots so that the serrated end of each terminal blade engages one of the wires.

4. The RJ-type plug as set forth in claim 1, wherein the wire shields are coupled to an electrical reference potential.

* * * * *